US010342286B2

(12) United States Patent
Sussmann

(10) Patent No.: US 10,342,286 B2
(45) Date of Patent: Jul. 9, 2019

(54) SHOE, IN PARTICULAR A SPORTS SHOE, AND METHOD FOR TIGHTENING SUCH A SHOE

(71) Applicant: PUMA SE, Herzogenaurach (DE)

(72) Inventor: Reinhold Sussmann, Scheinfeld (DE)

(73) Assignee: PUMA SE, Herzogenaurach (DE)

( * ) Notice: Subject to any disclaimer, the term of this patent is extended or adjusted under 35 U.S.C. 154(b) by 0 days.

(21) Appl. No.: 15/735,132

(22) PCT Filed: Jan. 30, 2016

(86) PCT No.: PCT/EP2016/000158

§ 371 (c)(1),
(2) Date: Dec. 8, 2017

(87) PCT Pub. No.: WO2017/129201

PCT Pub. Date: Aug. 3, 2017

(65) Prior Publication Data

US 2018/0168277 A1 Jun. 21, 2018

(51) Int. Cl.

| | |
|---|---|
| ***A43B 23/00*** | (2006.01) |
| ***A43B 7/02*** | (2006.01) |
| ***A43B 7/04*** | (2006.01) |
| ***A43B 1/00*** | (2006.01) |
| ***A43B 23/02*** | (2006.01) |

(Continued)

(52) U.S. Cl.

CPC ..... *A43B 7/04* (2013.01); *A43B 1/00* (2013.01); *A43B 1/14* (2013.01); *A43B 3/0005* (2013.01); *A43B 3/26* (2013.01); *A43B 5/00* (2013.01); *A43B 23/026* (2013.01); *A43B 23/028* (2013.01); *A43B 23/0215* (2013.01); *A43B 23/0235* (2013.01)

(58) Field of Classification Search

CPC .... A43B 7/04; A43B 1/00; A43B 1/14; A43B 3/0005; A43B 3/26; A43B 23/0215; A43B 23/0235; A43B 23/026; A43B 23/028; A43B 5/0427; A43B 5/1608; A43B 5/1625

USPC ..... 36/2.6, 45, 68, 87, 93, 98

See application file for complete search history.

(56) References Cited

U.S. PATENT DOCUMENTS 8,065,818 B2 * 11/2011 Greene ..... A43B 9/00 36/45
8,356,429 B2 * 1/2013 Eder ..... A43B 5/02 36/114

(Continued)

FOREIGN PATENT DOCUMENTS

EP 2862467 A1 4/2015
JP 7102170 A 4/1995

(Continued)

*Primary Examiner* — Jameson D Collier
(74) *Attorney, Agent, or Firm* — Lucas & Mercanti, LLP

(57) ABSTRACT

A shoe, and a method for tightening such a shoe, in particular to a sports shoe, having a sole and a shoe upper, wherein the shoe upper has a first material section, which at least partially extends around the foot of the wearer of the shoe. To enable the tightening of the shoe on the foot of the wearer in a comfortable manner, a second material section is arranged on the outside of the first material section, in which the second material section at least partially covers the first material section, wherein the second material section is a plastic material having a shape memory effect.

10 Claims, 1 Drawing Sheet

(51) Int. Cl.

| | |
|---|---|
| ***A43B 1/14*** | (2006.01) |
| ***A43B 3/00*** | (2006.01) |
| ***A43B 3/26*** | (2006.01) |
| ***A43B 5/00*** | (2006.01) |

(56) References Cited

U.S. PATENT DOCUMENTS 8,525,386 B2 * 9/2013 Pas ..... A61B 5/1036 310/314
8,800,172 B2 * 8/2014 Dua ..... A43B 23/0235 36/50.1
8,894,567 B2 11/2014 Honda et al.
9,380,834 B2 * 7/2016 Rushbrook ..... A43B 23/16
9,460,557 B1 * 10/2016 Tran ..... B29C 64/386
2002/0100188 A1 8/2002 Jacques
2004/0181974 A1 * 9/2004 Robinson, Jr. ..... A43B 3/0078 36/100
2005/0016023 A1 * 1/2005 Burris ..... A43B 5/02 36/45
2005/0208860 A1 * 9/2005 Baron ..... A41D 27/28 442/414
2007/0113564 A1 * 5/2007 Whitney ..... A41D 19/01535 62/3.5
2009/0014424 A1 * 1/2009 Meschter ..... A41D 31/02 219/121.69
2009/0183392 A1 * 7/2009 Shane ..... A43B 1/0027 36/97
2010/0293076 A1 * 11/2010 End ..... G06Q 30/06 705/26.7
2011/0192059 A1 * 8/2011 Spanks ..... A43B 1/0072 36/137
2012/0000251 A1 1/2012 Hu
2012/0144698 A1 * 6/2012 McDowell ..... B29D 35/146 36/45
2012/0180341 A1 * 7/2012 Crowley, II ..... A43B 1/0009 36/103
2013/0025157 A1 * 1/2013 Wan ..... A43B 7/06 36/45
2013/0232815 A1 * 9/2013 Meythaler ..... A43B 23/0225 36/45
2013/0312284 A1 * 11/2013 Berend ..... A43B 1/0027 36/84
2014/0134378 A1 5/2014 Downs
2015/0052778 A1 * 2/2015 Kirk ..... A43B 1/0009 36/45
2015/0223552 A1 * 8/2015 Love ..... A43C 15/02 36/134
2015/0282564 A1 10/2015 Meschter
2015/0296922 A1 * 10/2015 Rushbrook ..... A43B 23/16 36/68
2015/0342284 A1 * 12/2015 Huffman ..... A43B 1/04 12/142 G
2015/0342285 A1 * 12/2015 Huffman ..... A43B 23/024 36/9 R
2015/0342286 A1 * 12/2015 Huffman ..... A43B 1/04 36/9 R
2016/0095377 A1 * 4/2016 Tamm ..... A43B 3/0036 36/9 R
2016/0309834 A1 * 10/2016 Zwick ..... A43B 5/025
2017/0112236 A1 * 4/2017 Park ..... A43B 23/0215

FOREIGN PATENT DOCUMENTS

JP 200983020 A 4/2009
WO 2010089923 A1 8/2010
WO 2016077221 A1 5/2016

* cited by examiner

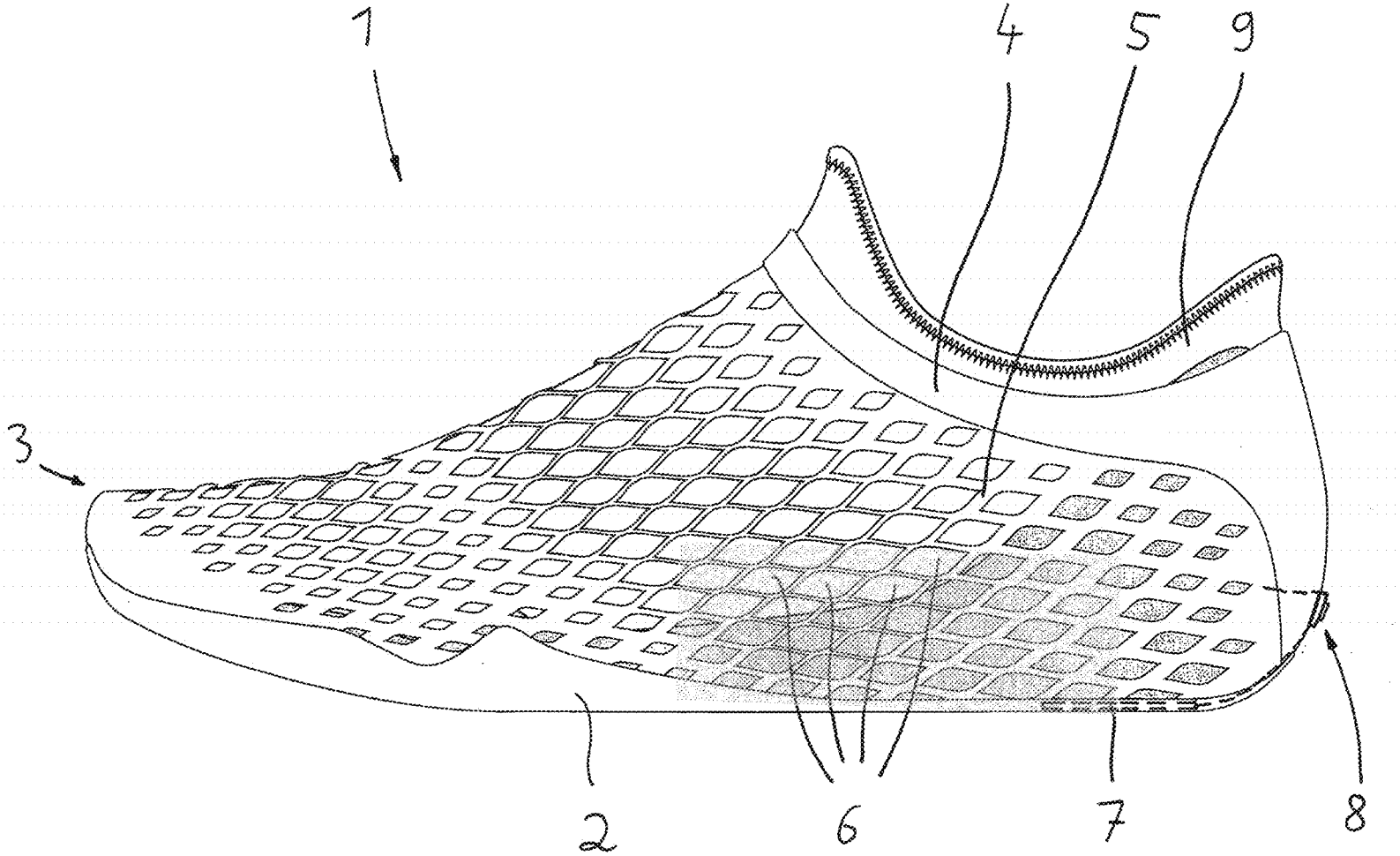
1
2
3
4
5
6
7
8
9

SHOE, IN PARTICULAR A SPORTS SHOE, AND METHOD FOR TIGHTENING SUCH A SHOE

The present application is a 371 of International application PCT/EP2016/000158, filed Jan. 30, 2016, the priority of this application is hereby claimed and this application is incorporated herein by reference.

BACKGROUND OF THE INVENTION

The invention relates to a shoe, in particular a sports shoe, comprising a sole and a shoe upper, wherein the shoe upper has a first material section which at least partially extends around the foot of the wearer of the shoe. Furthermore, the invention relates to a method for tying such a shoe.

Shoes according to the generic kind are well known in the state of the art. The shoe upper is connected with the shoe sole and is tied at the foot of the wearer after putting on the shoe. Typically, therefore laces are used which pull two tensioning sections of the shoe upper which are arranged adjacent to another.

Other solutions use a rotary fastener for tying the shoe at the foot of the wearer.

However it can always be said in general that a respective tying step by pulling of a lace or of a tensioning wire must take place to fix the shoe at the foot of the wearer sufficiently.

SUMMARY OF THE INVENTION

It is the object of the invention to further develop a generic shoe and to propose a corresponding method for tightening of the shoe by which it becomes possible to allow the tightening of the shoe at the foot of the wearer in a more comfortable manner. Thereby it should be possible to do preferably without the use of laces or tensioning wires totally.

The solution of the object by the invention is characterized in that a second material section is arranged on the outside of the first material section which second material section at least partially covers the first material section, wherein the second material section consists of a plastic material having a shape memory effect (memory effect).

The second material section is thereby preferably applied onto the first material section as a laminar coating.

The second material section is preferably designed in such a manner that it exerts a first compression force (which force can if applicable be also (almost) zero) onto the first material section at a first, low temperature which presses the first material section against the foot of the wearer of the shoe and that it exerts a second compression force onto the first material section at a second, high temperature which second compression force is higher than the first compression force, preferably at least 20% higher than the first compression force. The material of the second material section is thereby preferably designed in such a manner that the first temperature is lower than 25° C. and the second temperature is higher than 35° C., preferably higher than 40° C.

The material of the second material section consists preferably of thermoplastic polyurethane (TPU) or comprises this material. The thermoplastic polyurethane comprises preferably hard segments and soft segments which form a block copolymer. The hard segments consist preferably of polyurethane groups. The soft segments consist preferably of long-chained polyester regions.

The material of the second material section is specifically preferred designed as net or lattice which rests on the first material section, wherein the net or the lattice comprises preferably a plurality of apertures.

A specifically preferred embodiment of the invention provides that the material of the second material section is electrically conductive. In this case it can namely furthermore be provided that the electrically conductive material of the second material section is in connection with a battery by which the electrically conductive material can be charged or flowed through with electrical energy and current respectively via a switch element. By doing so a heating of the second material section results.

The battery is thereby preferably rechargeable. The recharging process can thereby take place by induction for which purpose the shoe is placed on a respective loading station.

The proposed method of tightening of a shoe comprises, according to the invention, the steps:

a) Putting on the shoe, wherein the second material section made of plastic material having a shape memory effect has a first low temperature, wherein the first temperature is preferably below 25° C.;

b) Subsequently: Heating up the second material section made of plastic material having a shape memory effect to a second high temperature, so that the second material section exerts a higher compression force onto the foot of the wearer of the shoe than at the first temperature, wherein the second temperature is preferably above 35° C., specifically preferred above 40° C.

The heating up of the second material section takes place thereby preferably by using electrically conductive material for the second material section which is charged with current. Especially the heating up of the second material section can take place by actuating a switch element which induces current from a battery into the material of the second material section.

For rising the wearing comfort it can be provided that the shoe upper comprises a sock-like insert (like a kind of inner shoe); this insert can be arranged in the inner of the first material section. In the inner of the sock-like section an inner sole can be arranged in turn.

The second material section, which is preferably designed net-like which functions as a compression element, can comprise a circumferential reinforcement edge in the region of the entry of the foot; this can be formed by a flat plastic band. Thereby, the net-like structure can extend down till the sole region; it can also extend completely around the bottom side of the shoe.

Thus, the invention is basing on the idea that the tightening of the shoe takes place by using specifically the properties of a plastic material with shape memory. By a selective heating up the said material after putting on the shoe, the second material section contracts slightly and exerts the desired compression force onto the first material section of the shoe upper.

The following should be mentioned in connection with the second material section made of plastic with shape memory according to the invention: Such a material is available at the marked (trademark: DESMOPAN®, especially DESMOPAN DP 2795A SMP). This is a thermoplastic block copolymer which properties can be selectively influenced. The linear polymer molecules of the material consist of a combination of flexible elastic segments with low glass transition temperature and stiff crystalline segments with high melting point. By the selective variation of those hard and soft phases the properties of the material can be influenced.

The material is thermoplastic polyurethane (TPU) and has shape memory properties. The second material section, which consists of this plastic material, can be brought temporarily into another shape and can be also fixed in the same. Thus, if only the soft segments are molten, it is possible to force the part into a temporary shape and to cross-link physically the same by crystallisation of the soft segments and to stabilize the same by doing so. If the material is heated up above a predetermined temperature (so-called switching temperature), it "memorizes" its original shape and takes up the same again. This effect is used presently for tightening the shoe. By a respective choice of the material components the switching temperature can be predetermined at about 40° C.

The shape memory effect is basing on the fact that the hard segments of the TPU form the phase with the highest transition temperature. This temperature is exceeded when the material is injection moulded to give it the permanent shape. The soft segments of the TPU which consists of long-chained polyester regions form a further phase with a significant lower transition temperature. When the switching temperature is reached only the soft segments melt so that the part can be brought into a temporary shape. During the cooling the soft segments link physically by crystallisation and the part remains this shape. Then, a later melting of the soft segment crystallites triggers the shape memory effect.

Beneficially, by the realization of the second material section and using the mentioned plastic material, it is reached that, after execution of the tightening process, the shoe rests optimal against the foot of the wearer and a very equal pressure distribution onto the foot of the wearer is obtained.

BRIEF DESCRIPTION OF THE DRAWING

In the drawing an embodiment of the invention is shown.

DETAILED DESCRIPTION OF THE INVENTION

In the FIGURE an embodiment of the shoe according to the invention can be seen. The shoe 1 has a sole 2 and a shoe upper 3 which is connected with the sole 2. The shoe upper 3 has as a base layer a first material section 4; this material section is designed continuous and laminar and surrounds the foot of the wearer (not depicted). On the first material section 4 a second material section 5 is arranged; presently, this is designed like a net which comprises a plurality of apertures 6. The inner of the shoe upper 3 is formed by a sock-like section 9 which surrounds the foot of the wearer.

It is essential that the second material section 5 consists of a plastic material with shape memory effect. With respect to this material already specific explanations are made above.

The mentioned shape memory effect is basing on the fact—as already explained—that shape memory polymers comprise a network structure, wherein the excess of a phase transition goes along with a significant change of the mechanical properties. The above mentioned material DESMOPAN® DP 2795A SMP fulfils those requirements as a phase segregated block copolymer.

The mentioned material differs from conventional TPU thus by the presence of an additional phase transition. Those phase transitions are used here in applications for shape memory polymers. Thus, a mechanical conditioning is possible at which the material is brought under force into a temporary shape.

A switching temperature between 34° C. and 45° C. is provided at which the crystallisation of the soft segments take place.

In the FIGURE, it can be seen that, in the sole 2, a battery 7 is arranged. A cable which is shown only schematically is connected with the material of the second material section 5, wherein the material of the second material section 5 can be flowed through by the current from the battery 7 via a switch element 8 (electrical switch). This is reached by the fact that the material of the second material section 5 was made conductive which is possible for example by inclusion of carbon particles into the plastic material. The current which is flowing through the second material section creates the required (but relatively minor) heating of the material because the material is acting as an ohmic resistance; thus, if a current is flowing from the battery through the material of the second material section 5, the material section 5 is heated up. If this takes place up to a temperature above ca. 40° C. (i. e. above the switching temperature), the explained shape memory effect takes place which triggers the tightening process.

LIST OF REFERENCES

1 Shoe
2 Sole
3 Shoe upper
4 First material section
5 Second material section
6 Apertures
7 Battery
8 Switch element
9 Sock-like section

The invention claimed is:

1. A shoe, comprising a sole and a shoe upper, wherein the shoe upper has a first material section, which is configured to at least partially extend around a foot of a wearer of the shoe, and a second material section that is arranged on an outside of the first material section, wherein the second material section at least partially covers the first material section, wherein the second material section consists of a plastic material having a shape memory effect, and a battery and a switch element, wherein the material of the second material section is electrically conductive and the electrically conductive material of the second material section is in connection with the battery via the switch element, wherein the switch element is selectively switchable to a charge position in which the electrically conductive material is charged with electrical energy by the battery, wherein the second material section exerts a first compression force onto the first material section at a first temperature, the first compression force being configured to press the first material section against the foot of the wearer of the shoe, the second material section conducts the electrical energy and heats up to a second temperature when the switch element is in the charge position, the second temperature being greater than the first temperature, and the second material section contracts and exerts a second compression force onto the first material section at the second temperature, wherein the second compression force is greater than the first compression force, and wherein the second material section is:

(i) applied onto the first material section as a laminar coating; or (ii) designed as a net or a lattice which rests on the first material section, wherein the net or the lattice comprises a plurality of apertures.

2. The shoe according to claim 1, wherein the battery is rechargeable.

3. The shoe according to claim 1, wherein the second material section is applied onto the first material section as the laminar coating.

4. The shoe according to claim 1, wherein the first temperature is less than 25° C. and the second temperature is greater than 35° C.

5. The shoe according to claim 4, wherein the second temperature is greater than 40° C.

6. The shoe according to claim 1, wherein the material of the second material section is designed as the net or the lattice which rests on the first material section, wherein the net or the lattice comprises the plurality of apertures.

7. The shoe according to claim 1, wherein the second compression force is at least 20% greater than the first compression force.

8. A method for tightening a shoe according to claim 1, comprising the steps:

a) putting the shoe on the foot of the wearer when the second material section has the first temperature, wherein the first temperature is less than 25° C.;

b) heating up the second material section to the second temperature, so that the second material section exerts the second compression force onto the foot of the wearer of the shoe, wherein the second temperature is greater than 35° C.

9. The method according to claim 8, wherein the step of heating up of the second material section takes place by using the electrically conductive material of the second material section which is charged with current.

10. The method according to claim 9, wherein the step of heating up of the second material section takes place by actuating the switch element which induces current from the battery into the material of the second material section.

* * * * *